United States Patent [19]

Pelengaris

[11] 4,128,861

[45] Dec. 5, 1978

[54] ILLUMINATED SHOE

[76] Inventor: Akis Pelengaris, 1109 Wm. Floyd Pkwy., Shirley, N.Y. 11967

[21] Appl. No.: 781,757

[22] Filed: Mar. 28, 1977

[51] Int. Cl.[2] ..... F21V 33/00

[52] U.S. Cl. ..... 362/103

[58] Field of Search ..... 362/103

[56] References Cited

U.S. PATENT DOCUMENTS

| | | | |
|---|---|---|---|
| 1,933,243 | 10/1933 | Merolis et al. | 362/103 |
| 3,800,133 | 3/1974 | Duval | 362/103 |
| 3,946,505 | 3/1976 | Dana | 362/103 |

*Primary Examiner*—Brooks H. Hunt

*Attorney, Agent, or Firm*—Alexander Mencher

[57] ABSTRACT

An illuminated shoe activated by the heel thereof contacting a supporting surface including a shoe, a hollow heel fixedly secured to the shoe, illumination means disposed within a chamber provided by the heel and visible outside said heel, and means for activating said illumination means when the lower surface of the heel contacts a supporting surface.

3 Claims, 3 Drawing Figures

ILLUMINATED SHOE

BACKGROUND OF THE INVENTION

1. Field of the Invention

The present invention relates to illuminated shoes, and more particularly, to an illuminated shoe which is activated when the heel portion thereof contacts a supporting surface.

2. Description of the Prior Art

The proposal of illuminated footwear has been long standing. Several devices known propose elaborate built in wiring schemes which prove costly to manufacture. Also, most known devices provide constant illuminating which necessitates frequent replacement of batteries.

To provide an illuminated shoe which may be fabricated with little departure from current manufacturing techniques several proposals have been made for illumination means disposed entirely within the heel portion of a shoe. Such an apparatus is disclosed in U.S. Pat. No. 1,597,832 issued to S. Randolph on Aug. 31, 1926.

U.S. Pat. No. 3,800,133 issued to H. J. Duval on March 26, 1974 teaches an illuminated shoe providing a lamp and battery in the heel thereof. Pressure on the insole of the shoe closes a pair of contacts and activates the battery. For practical purposes, when the user's foot is inserted in a properly fitted shoe the sole will be pressured and the lamp illuminated. Also, shoes manufactured using this principle may prove to be uncomfortable in the area of the switch as a result of lack of support.

U.S. Pat. No. 1,933,243 issued to J. De Merolis et al. on Oct. 31, 1933 discloses an illuminated shoe activated by the urging of a push button protruding out of the lower surface of the heel of the shoe. Although this arrangement provides for intermittent operation to conserve battery power, the electrical contacts affixed to the push button can easily be rendered inoperative as a result of moisture or dirt entering the heel through the aperture which the push button protrudes through.

The present invention overcomes the problems associated with the prior art by providing an illuminated shoe having the illuminating means thereof entirely enclosed in the heel thereof, by providing for intermittent activation of the illuminating means, and by protecting the illuminating means from undue exposure to dirt or moisture.

SUMMARY OF THE INVENTION

Therefore, it is a primary object of the present invention to provide an illuminated shoe having the illumination means thereof entirely contained within the heel portion thereof.

A further object is to provide an illuminated shoe which may be manufactured with minimal alteration of present uppers fabrication techniques.

A still further object is to provide an illuminated shoe which is activated by the user pressuring the heel portion thereof against a suporting surface.

Another object is to provide an illuminated shoe which is simple in design, inexpensive to manufacture, and durable.

These objects, as well as further objects and advantages of the present invention will become readily apparent after reading the description of a non-limiting illustrative embodiment and the accompanying drawing.

According to the principles of the present invention, an illuminated shoe includes a shoe having an upper foot receiving portion and a sole portion; a hollow heel fixedly secured on the upper surface thereof to the sole adjacent the rear portion thereof, a portion of the heel adjacent the sides thereof providing an illumination opening, the heel forming a chamber therein; illumination means disposed within the chamber and visible through the illumination opening; and means for activating the illumination means when the lower surface of the heel contacts a supporting surface.

BRIEF DESCRIPTION OF THE DRAWINGS

In order that the present invention may be more fully understood it will now be described, by way of example, with reference to the accompanying drawings in which.

DESCRIPTION OF THE PREFERRED EMBODIMENT

Figure 1:
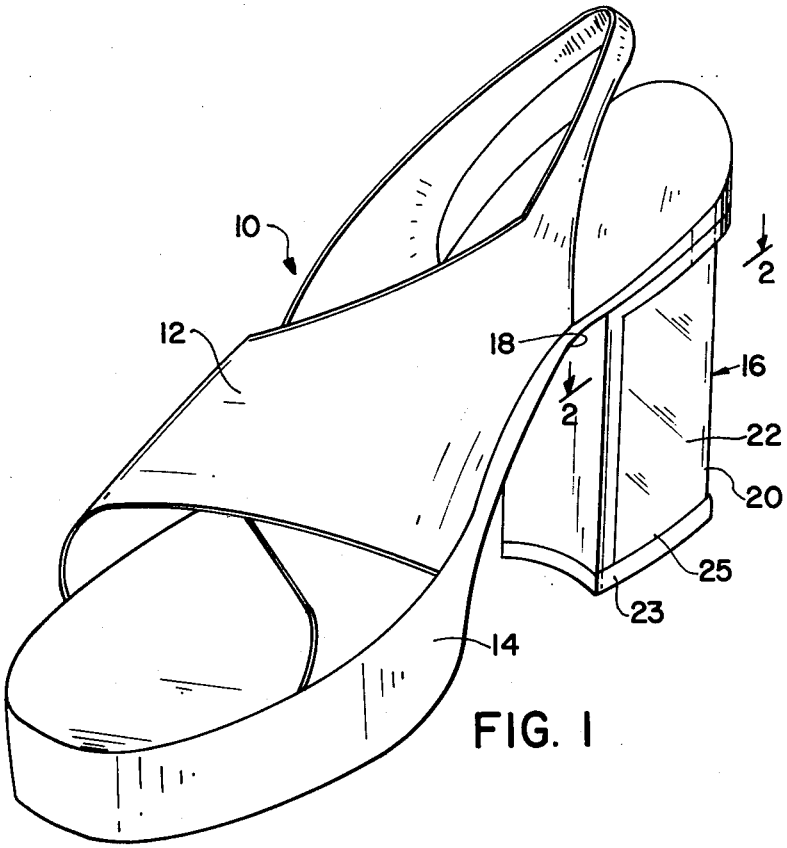
FIG. 1 is a perspective view of the preferred embodiment incorporating the principles of the present invention.
Figure 2:
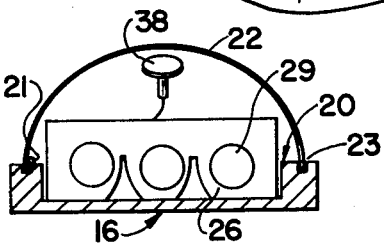
FIG. 2 is a sectional view taken substantially through the lines 2—2 of FIG. 1.
Figure 3:
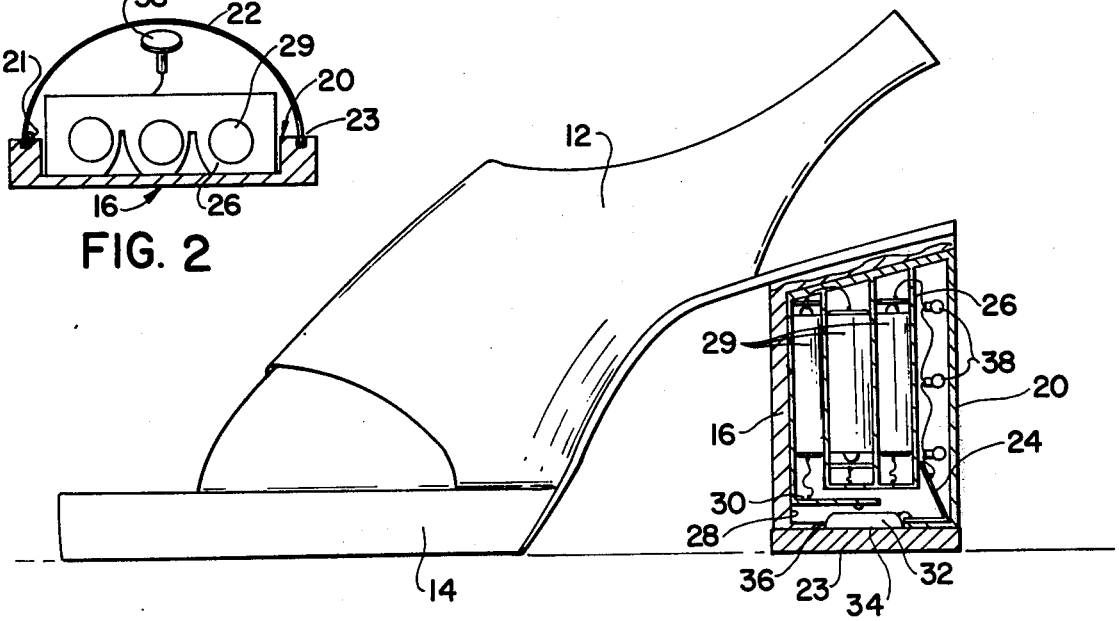
FIG. 3 is a partially broken away side view in elevation of the preferred embodiment.

Referring now to the figures, and more particularly to FIGS. 1 and 2, there is illustrated therein an illuminated shoe 10. The shoe 10 includes an upper foot receiving portion 12 and a sole portion 14. A hollow heel 16 is fixedly secured to the lower surface 18 of the sole portion 14. The heel 16 has an illumination opening 20 located therein. A transparent lens 22 is removeably secured over the illumination opening 20. The lens 22 is secured by a groove 23 provided in the heel 16 or by other suitable means. To prevent moisture from entering the heel 16 a gasket 21 is preferably provided adjacent the illuminated opening 20. The gasket preferably contacts the lens 22 and creates a moisture seal. A resilient pad 23 is fixedly secured to the lower surface 25 of the heel 16.

FIG. 2 illustrates a chamber 24 formed within the hollow heel 16. A plurality of battery holders 26 are fixedly secured within the chamber 24 to the walls 28 thereof. A plurality of batteries 29 are installed in the battery holders 26. A first electrical contact 30 is fixedly secured to the walls 28 of the chamber 24. A second electrical contact 32 is fixedly secured to a portion 34 of the resilient pad 23 adjacent an activation opening 36 provided through the lower surface 25 of the heel 16. The first contact 30 falls adjacent the second contact 32 and as the pad 23 contacts a supporting surface the second contact 32 is urged against the first contact 30. A plurality of lamps 38 are operably connected to the battery holders 26 and the first and second electrical contacts 30 and 32. When the contacts 30 and 32 are urged together the lamps 38 are illuminated and visible through the lens 22. Although three batteries are illustrated in series with three lamps, a different number of components wired in series or parallel may be used.

It will be understood that various changes in the details, materials, arrangements of parts and operation conditions which have been herein described and illustrated in order to explain the nature of the invention may be made by those skilled in the art within the principles and scope of the invention.

Having thus set forth the nature of the invention, what is claimed is:

1. An illuminated shoe comprising:

a. a shoe having an upper foot receiving portion and a sole portion including a rear area thereof;

b. a hollow heel defining a chamber therein and including a top, an inner end and a bottom wall, said bottom wall having a central opening, said top wall being fixedly secured on the upper surface thereof to said sole portion adjacent the rear area thereof.

c. an electrical storage battery holder spaced above said bottom wall and secured to any of said other walls and at least one electrical storage battery being removably mounted therein;

d. at least one illuminating lamp coupled to said battery and adapted to be mounted on said battery holder;

e. a resilient pad secured to the outer surface of said bottom wall and having an electrical activating contact penetrating said central opening and being operably connected to said lamp;

f. another electrical actuating contact fixedly secured within the heel chamber and spaced above and opposite said first mentioned electrical actuating contact and operably connected to said battery whereby the movement of said pad when pressed against a rigid surface closes the electrical circuit for illuminating said lamp;

g. a heel side wall having an access opening for the interior of the said chamber;

h. a transparent member opposite said lamp; and i. means for removable and seal tight affixation of said transparent member over said acess opening.

2. An illuminated shoe as set forth in claim 1 wherein said transparent member is a lens for light projection.

3. An illuminated shoe as set forth in claim 2 wherein said means comprises grooving and gasketing elements adjacent said access opening.

* * * * *